US006953017B2

(12) United States Patent
Matsuda

(10) Patent No.: US 6,953,017 B2
(45) Date of Patent: Oct. 11, 2005

(54) PLUG CAP MOUNT STRUCTURE FOR ENGINE

(75) Inventor: Minoru Matsuda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/896,115

(22) Filed: Jul. 22, 2004

(65) Prior Publication Data

US 2005/0045133 A1 Mar. 3, 2005

(30) Foreign Application Priority Data

Jul. 24, 2003 (JP) ..... 2003-279184

(51) Int. Cl.[7] ..... F02P 1/00
(52) U.S. Cl. ..... 123/169 PH; 123/169 PA; 123/169 P
(58) Field of Search ..... 123/169 R, 169 EL, 123/169 P, 169 PA, 169 PH

(56) References Cited

U.S. PATENT DOCUMENTS 6,193,528 B1 * 2/2001 Rea et al. ..... 439/127
6,467,447 B1 * 10/2002 Holmes et al. ..... 123/169 PA
6,508,216 B2 * 1/2003 Holmes et al. ..... 123/169 PA

FOREIGN PATENT DOCUMENTS

JP 11-144839 A 5/1999

* cited by examiner

*Primary Examiner*—Bibhu Mohanty
(74) *Attorney, Agent, or Firm*—Birch, Stewart, Kolasch & Birch, LLP

(57) ABSTRACT

A plug cap guide for enhancing the reliability of mounting a plug cap to a rear portion of a spark plug. The plug cap guide is formed in a hollow cylindrical shape so as to contain a plug cap therein and to have a tip end portion insertable in a plug hole. The plug cap guide is provided with a pressing portion for pressing the plug cap toward the side of a spark plug. A positioning and fixing element for determining the position in the axial direction of the plug cap guide and fixing the plug cap guide is provided between a rear portion of the plug cap guide and a head cover.

18 Claims, 9 Drawing Sheets

PLUG CAP MOUNT STRUCTURE FOR ENGINE

CROSS-REFERENCE TO RELATED APPLICATION

The present application claims priority under 35 U.S.C. §119 to Japanese Patent Application No. 2003-279184, filed Jul. 24, 2003, the entire contents of which are hereby incorporated by reference.

BACKGROUND OF THE INVENTION

1. Field of the Invention

The present invention relates to improvements in a plug cap mount structure for engine. A rear portion of a spark plug mounted to a cylinder head is contained in a plug hole provided in the cylinder head. A plug cap for electrically connecting a high-tension cord to a terminal portion provided at the rear end of the spark plug is elastically fitted over a rear portion of the spark plug.

2. Description of Background Art

A plug cap mount structure for engine has been already known, as described in, for example, Japanese Patent Laid-open No. Hei 11-144839. In the document, a plug cap extends to be comparatively long along the axial direction of and inside a plug hole provided in a cylinder head. The plug cap is elastically fitted over a rear portion of a spark plug so as to electrically connect a high-tension cord to a terminal portion at the rear end of the spark plug.

In the above-mentioned conventional structure, however, the acting direction of an external force exerted on the plug cap, when the plug cap is pushed into the plug hole, may be inclined relative to the axis of the plug cap. The plug cap is pushed into the plug bole so as to elastically fit the plug cap over a rear portion of the spark plug. In such a case, the plug cap may buckle inside the plug hole. Therefore, it is difficult to favorably fit the plug cap over the rear portion of the spark plug. In addition, when the plug cap is pulled so as to release the plug cap from the spark plug for replacement of the spark plug or the like purpose, an excessive pulling force may be exerted on a high-tension cord mount portion. It is necessary to be sufficiently careful at the time of dismounting the plug cap for such occasions.

SUMMARY AND OBJECTS OF THE INVENTION

The present invention has been made in consideration of the above-mentioned circumstances. Accordingly, it is a first object of the present invention to provide a plug cap mount structure for engine by enhancing the reliability in mounting a plug cap to a rear portion of a spark plug. It is a second object of the present invention to provide a plug cap mount structure for engine by enhancing the workability in dismounting a plug cap from a rear portion of a spark plug.

In order to attain the above-mentioned first object, a first aspect of the present invention includes a spark plug mounted to a cylinder head, a rear portion of the spark plug being contained in a plug hole provided in the cylinder head, and a plug cap for electrically connecting a high-tension cord to a terminal portion of the spark plug, the plug cap being elastically fitted over the rear portion of the spark plug. A plug cap guide formed in a hollow cylindrical shape so as to contain the plug cap therein and having a tip end portion insertable in the plug hole is provided with a pressing portion for pressing the plug cap toward the side of the spark plug, and positioning and fixing means for determining the position in the axial direction of the plug cap guide and fixing the plug cap guide is provided between a rear portion of the plug cap guide and the cylinder head or a head cover coupled to the cylinder head.

In addition, in order to attain the above-mentioned second object, the a second aspect of the present invention includes a spark plug mounted to a cylinder head, a rear portion of the spark plug being contained in a plug hole provided in the cylinder head, and a plug cap for electrically connecting a high-tension cord to a terminal portion of the spark plug, the plug cap being elastically fitted over the rear portion of the spark plug. A plug cap guide formed in a hollow cylindrical shape so as to contain the plug cap therein is detachably fixed to the cylinder head or to a head cover coupled to the cylinder head, with a tip end portion of the plug cap guide being inserted in the plug hole, and an engaging portion for engagement with the plug cap from the side of the spark plug at the time of releasing the plug cap guide from the cylinder head or the head cover is provided at a tip end portion of the plug cap guide so that the plug cap can be separated from the rear portion of the spark plug according to the operation of releasing the plug cap guide.

A third aspect of the present invention includes a plug cap guide formed of a conductive metal so as to provide a shield for electrical connection portions of the spark plug and the high-tension cord.

A fourth aspect of the present invention includes a mount hole coaxial with the plug hole is provided in the head cover, with an axial spacing provided between the plug hole and the mount hole, and a rear portion of the plug cap guide is passed through the mount hole and fixed to the head cover.

A fifth aspect of the present invention sets forth that the positioning and fixing element is composed of a male screw provided at the outer circumference of a rear portion of the plug cap guide, a step portion provided at the outside surface of the plug cap guide in the state of fronting on the tip end side, a female screw provided in the cylinder head or the head cover for screw engagement with the male screw, and a restriction step portion provided in the cylinder head or the head cover so as to make contact with the step portion, and an engaging groove capable of engagement with a tool for rotating the plug cap guide is provided at the rear end of the plug cap guide.

Furthermore, a sixth aspects of the present invention sets forth that the positioning and fixing means is composed of a pin rooted in a rear portion of the plug cap guide so as to have one end portion projected from the outer circumference of the plug cap guide, and a groove provided in the cylinder head or the head cover for engagement with the one end portion of the pin, and the groove is formed in a roughly J shape while including a slide groove portion extending in parallel to the axis of the plug cap guide and opening at the outer end thereof, and an engaging groove portion being continuous with the inner end of the slide groove portion so that the one end portion of the pin slid in the slide groove portion toward the inner end portion side can be engaged with the engaging groove portion by turning of the plug cap about the axis thereof.

According to the first aspect of the invention, the plug cap guide containing the plug cap therein is positionedly fixed to the cylinder head or the head cover, whereby the plug cap pressed toward the spark plug side is fitted over the rear portion of the spark plug and is guided by the plug cap guide. This makes it possible to prevent the plug cap from turning over and, hence, to enhance the reliability in mounting the plug cap onto the rear portion of the spark plug.

In addition, according to the second aspect of the invention, when the positioning and fixing of the plug cap guide to the cylinder head or the head cover is canceled and the plug cap guide is pulled out in the condition where the plug cap is fitted over the rear portion of the spark plug, the engaging portion of the plug cap guide comes into engagement with the plug cap from the spark plug side. Therefore, the plug cap is pushed so as to cancel the fitting between the plug cap and the spark plug according to the operation of pulling out the plug cap guide. As a result, it is possible to enhance the workability in dismounting the plug cap from the rear portion of the spark plug, while preventing an excessive load from acting on the plug cap.

According to the third aspect of the invention, it is possible to reduce noises coming from the above-mentioned connection portions to the exterior, and to alleviate the influences of a high-voltage action, which are exerted from the exterior to the connection portions.

According to the fourth aspect of the invention, it is possible to reduce the space, which is required of the cylinder head in the surroundings of the plug cap guide for disposing the plug cap guide. Also, enhancing intake and exhaust efficiencies can be realized through reductions in the including angle of intake and exhaust valves disposed in the cylinder head. As a result, it is possible to enhance the maintainability of the spark plug, while ensuring that the engine is enhanced in ignition performance, through disposing the spark plug in a central area of the combustion chamber.

According to the fifth aspect of the invention, it is possible to eliminate the need for a special tool for rotating the plug cap guide, to easily mount and dismount the plug cap guide onto and from the cylinder head or the head cover, and to thereby enhance the maintainability.

Furthermore, according to the sixth aspect of the invention, it is possible to easily mount and dismount the plug cap guide onto and from the cylinder head or the head cover, without need for a special tool, and to enhance the maintainability.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, a mode for carrying out the present invention will be described below based on one embodiment of the invention illustrated in the accompanying drawings.

FIGS. 1 to 7 illustrate a first embodiment in which the present invention is applied to a four-cycle horizontally-opposed four-cylinder engine.

Figure 1:
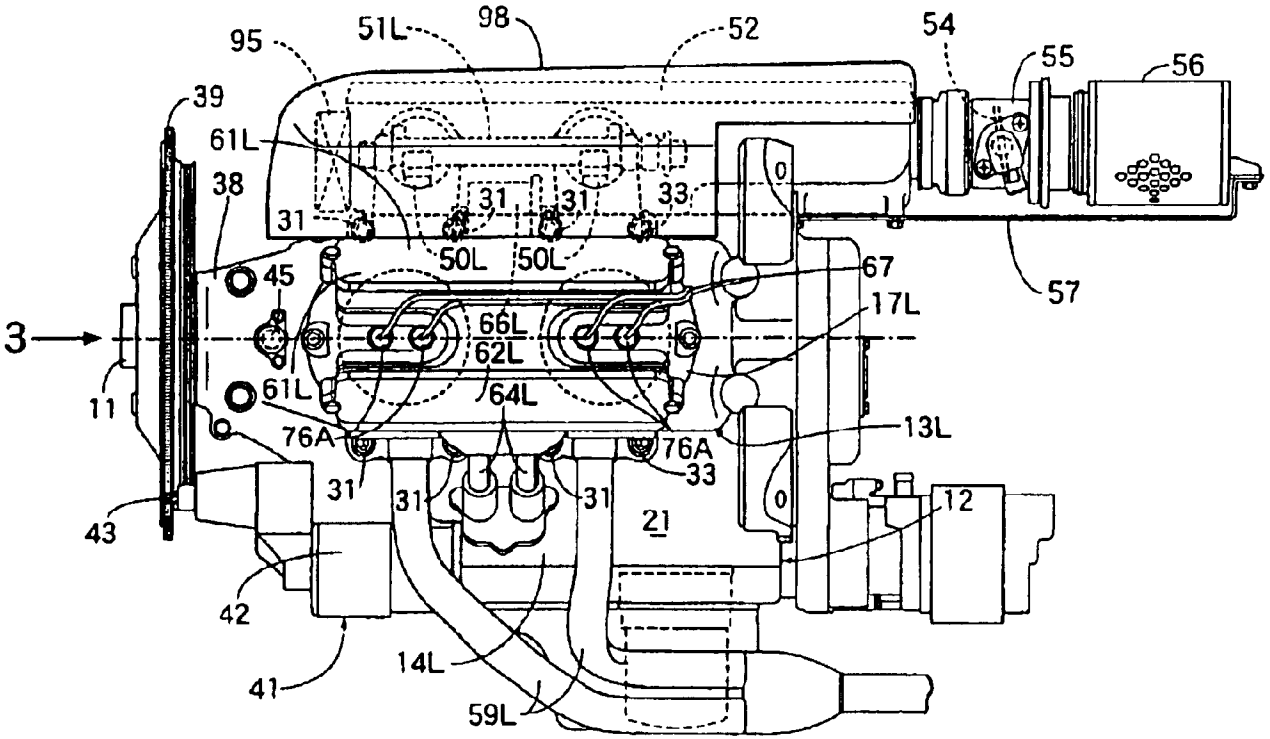
FIG. 1 is a side view of an engine according to a first embodiment.
Figure 2:
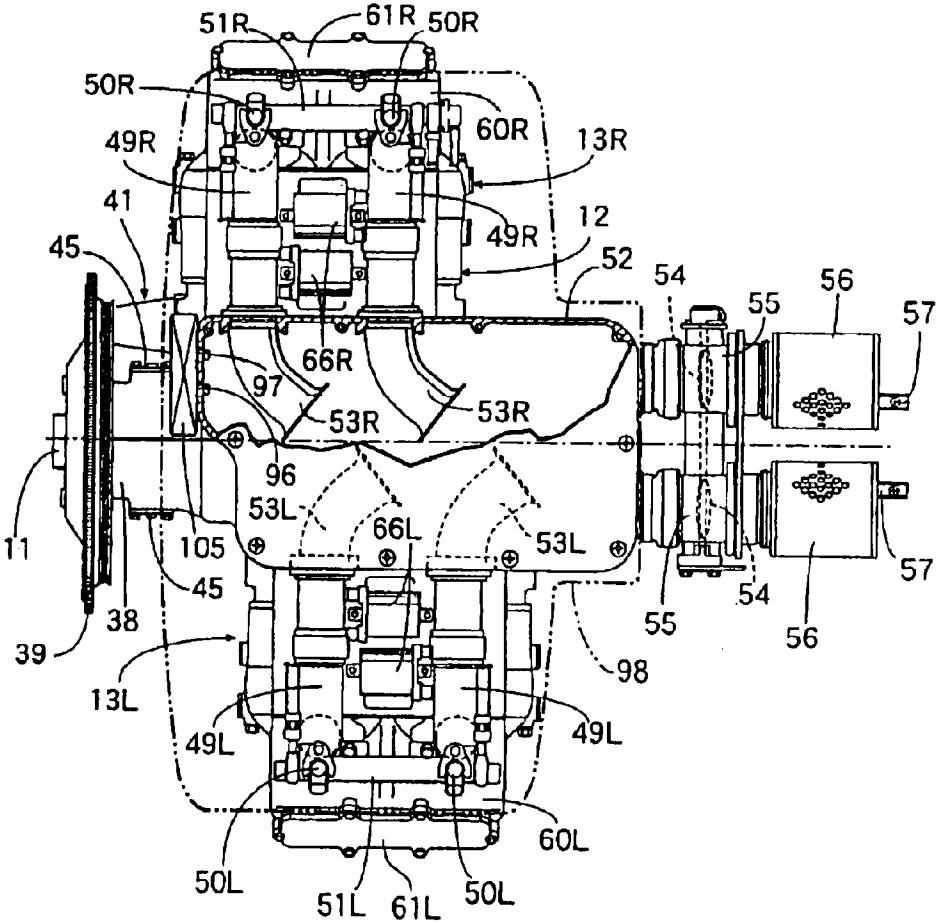
FIG. 2 is a partly cutout plan view of the engine.
Figure 3:
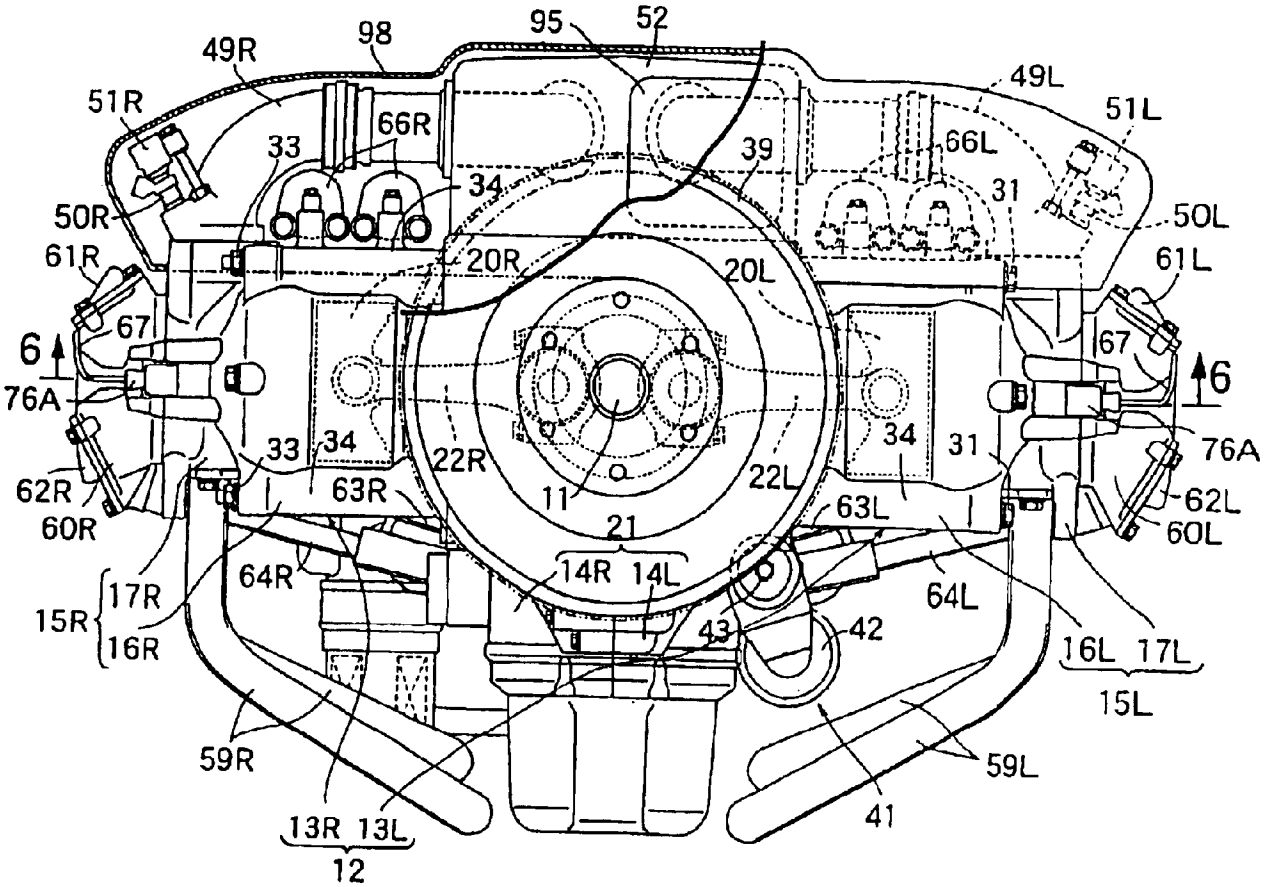
FIG. 3 is an enlarged front view taken along arrow 3 of FIG. 1.

First in FIGS. 1 to 3, the four-cycle horizontally-opposed four-cylinder engine is, for example, an engine to be mounted on an airplane. The engine is contained in a front cowl of the body of the airplane so that the axis of a crankshaft 11 is set along the front-rear direction. A spinner having a plurality of propellers is coaxially coupled to the crankshaft 11.

Figure 4:
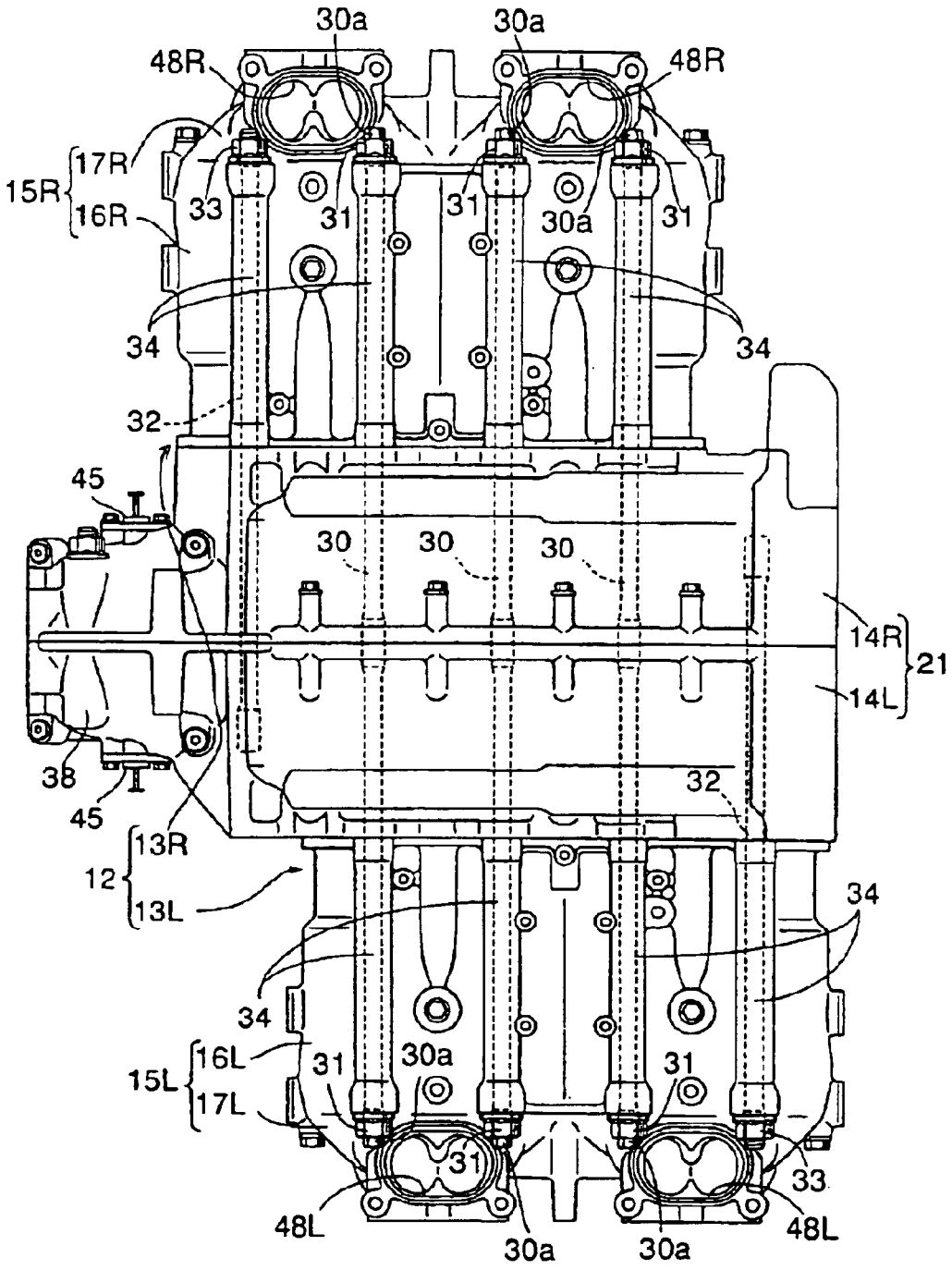
FIG. 4 is a plan view of an engine main body.
Figure 5:
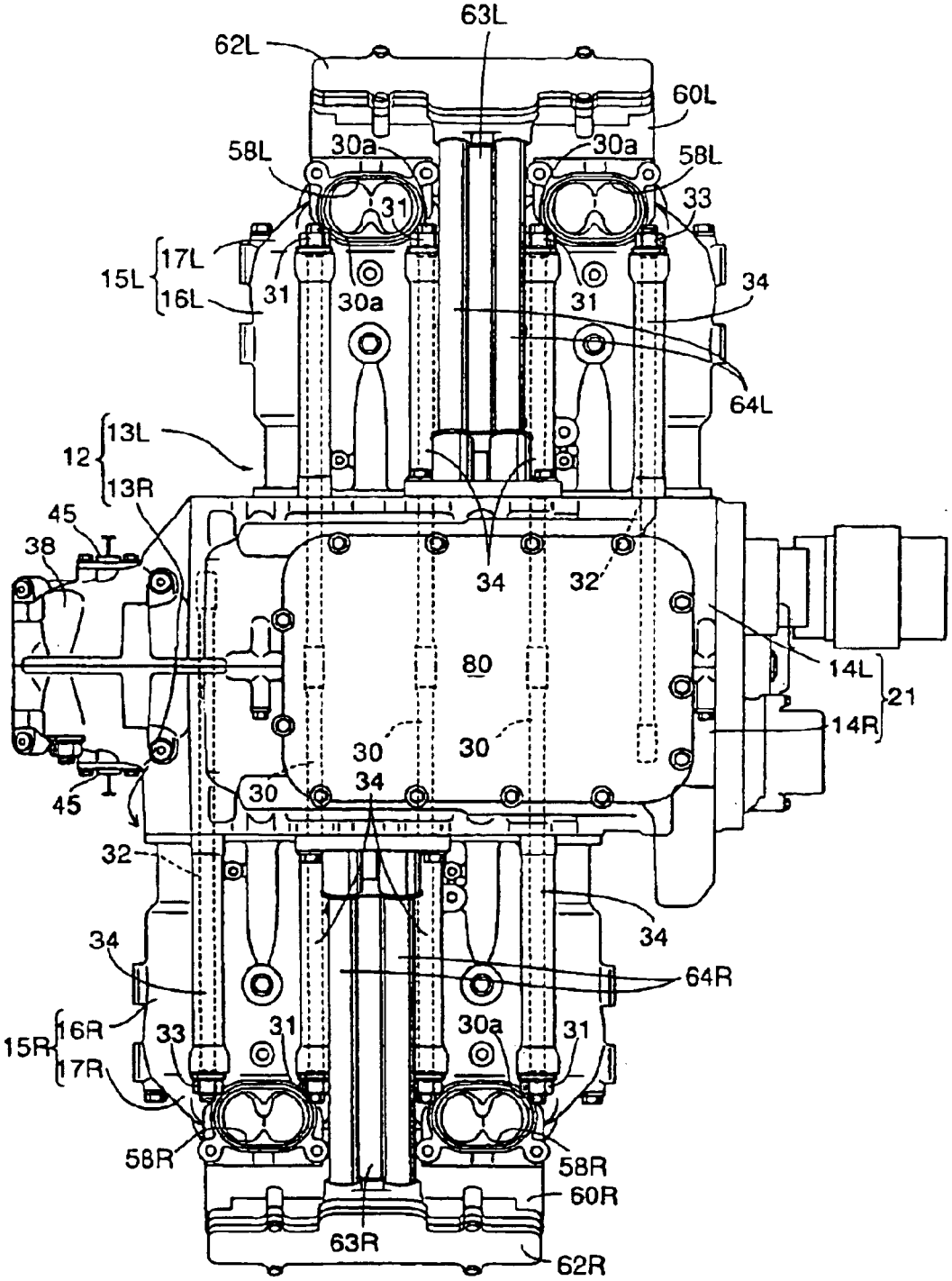
FIG. 5 is a bottom view of the engine main body.

Referring to FIGS. 4 and 5 also, an engine main body 12 of the engine includes a left engine block 13L disposed on the left side as the engine is viewed from the rear side, and a right engine block 13R disposed on the right side as the engine is viewed from the rear side.

The left engine block 13L includes a left crankcase 14L, and a left cylinder block 15L coupled to the left crankcase 14L, whereas the right engine block 13R includes a right crankcase 14R coupled to the left crankcase 14L, and a right cylinder block 15R coupled to the right crankcase 14R on the opposite side of the left crankcase 14L.

The left cylinder block 15L is composed of a left cylinder barrel 16L coupled to the left crankcase 14L, and a left cylinder head 17L formed integrally with the left cylinder barrel 16L on the opposite side of the left crankcase 14L, whereas the right cylinder block 15R is composed of a right cylinder barrel 16R coupled to the right crankcase 14R, and a right cylinder head 17R formed integrally with the right cylinder barrel 16R on the opposite side of the right crankcase 14R.

Figure 6:
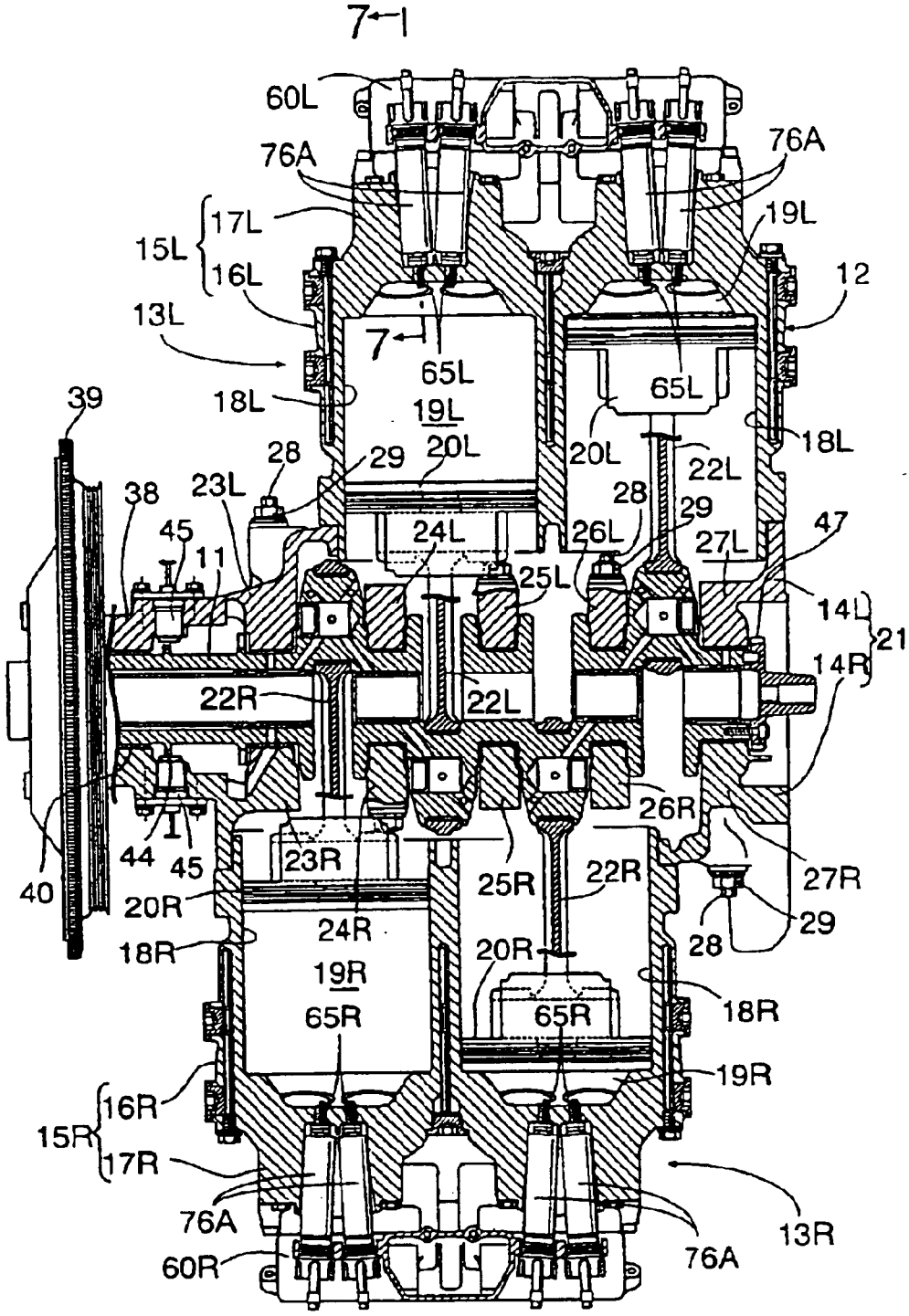
FIG. 6 is a sectional view taken along line 6—6 of FIG. 3.

Referring further to FIG. 6 also, the cylinder barrels 16L, 16R of both the cylinder blocks 15L, 15R are provided with respective pairs of cylinder bores 18L, 18L; 18R, 18R. The bores 18L, 18L; 18R, 18R are opposed to each other with the crankshaft 11 therebetween to be arranged along the axial direction of the crankshaft 11 and to be set off from each other in the axial direction of the crankshaft 11. Pistons 20L . . . , 20R . . . are slidably fitted in the cylinder bores 18L . . . , 18R . . . so as to form combustion chambers 19L . . . , 19R . . . between the pistons 20L . . . , 20R . . . and the cylinder heads 17L, 17R, respectively.

Both engine blocks 13L, 13R are disposed opposite to each other, with the axes of the cylinder bores 18L . . . , 18R . . . substantially parallel to each other. The left and right crankcases 14L, 14R are fastened to each other so as to cooperate with each other in constituting the crankcase 21. The crankshaft 11 coupled to both the pistons 20L . . . , 20R . . . through connecting rods 22L . . . , 22R . . . is rotably borne between the left and right crankcases 14L and 14R.

The left crankcase 14L is provided with a front journal support wall 23L, a first intermediate journal support wall 24L, a second internal journal support wall 25L, a third intermediate journal support wall 26L, and a rear journal support wall 27 for bearing a left half portion of the crankshaft 11 on both the front and rear sides of the connecting rods 22L . . . . The journal support walls are spaced from each other in the front-rear direction. The right crankcase 14R is provided with a front journal support wall 23R, a first intermediate journal support wall 24R, a second intermediate journal support wall 25R, a third intermediate journal support wall 26R, and a rear journal support wall 27R for bearing a right half portion of the crankshaft 11 on both the front and rear sides of the connecting rods 22R . . . . The journal support walls are spaced from each other in the front-rear direction. The crankshaft 11 is rotatably borne by the journal support walls 23L to 27L of the left crankcase 14L and the journal support walls 23R to 27R of the right crankcase 14R.

The journal support walls 23L to 27L, 23R to 27R of the left and right crankcases 14L, 14R are fastened by upper-lower pairs of stud bolts 28 . . . and nut 29 . . . disposed on the left and right sides of the crankshaft 11.

Meanwhile, the stud bolts 28 . . . for fastening the front journal support walls 23L, 23R and the rear journal support walls 27L, 27R are formed to be longer than the stud bolts 28 . . . for fastening the first, second, and third intermediate journal support walls 24L to 26L; 24R to 26R.

The nuts 29 . . . engaged with the outside surface of the right crankcase 14R are screw-engaged with the stud bolts 28 . . . that are rooted in the front journal support wall 23L of the left crankcase 14L. The bolts 28 are passed through the front journal support wall 23R of the right crankcase 14R. The nut 29 . . . engaged with the outside surface of the left crankcase 14L are screw-engaged with the stud bolts 28 . . . that are rooted in the rear journal support wall 27R of the right crankcase 14R. The bolts 28 are passed through the rear journal support wall 27L of the left crankcase 14L.

In addition, the nut 29 . . . are screw-engaged with the stud bolts 28 . . . that are rooted in the second and third intermediate journal support walls 25L, 26L of the left crankcase 14L. The bolts 28 are passed through the second and third intermediate journal support walls 25R, 26R of the right crankcase 14R, in the manner of being engaged with the support walls 25R, 26R. The nut 29 . . . are screw-engaged with the stud bolts 28 . . . that are rooted in the first intermediate journal support wall 24R of the right crankcase 14R. The bolts 28 are passed through the first intermediate journal support wall 24L of the left crankcase 14L, in the manner of being engaged with the support wall 24L.

In addition, the left and right engine blocks 13L, 13R are coupled to each other by pairs of through-bolts 30 . . . and two pairs of stud bolts 32 . . . . The through-bolts 30 are disposed at portions corresponding to the first, second, and third intermediate journal walls 24L to 26L, 24R to 26R of both the crankcases 14L, 14R.

The stud bolts 28 . . . are disposed in pairs at the first to third intermediate journal support walls 24L to 26L, 24R to 26R so as to fasten the first to third support walls 24L to 26L, 24R to 26R together. The through-bolts 30 . . . penetrate through the left and right engine blocks 13L, 13R so as to locate the bolts 28 between the through-bolts 30 . . . and the crankshaft 11. Nuts 31 . . . are screw-engaged with both end portions of the through-bolts 30 . . . projecting from the cylinder heads 17L, 17R of the left and right engine blocks 13L, 13R. In order that the through-bolts 30 . . . are not rotated at the time of fastening the nuts 31 . . . , for example, hexagonal tool engagement portions 30*a* . . . for engagement of a tool (not shown) therewith are coaxially provided at both ends of the through-bolts 30 . . . so as to project from the nuts 31 . . . .

Besides, one pair of the stud bolts 32 . . . of the two pairs of the stud bolts 32 . . . are rooted in the front journal support wall 23L of the left crankcase 13L and penetrate through the right engine block 13R. Nuts 33 . . . are screw-engaged with the stud bolts 32 . . . projecting from the cylinder head 17R of the right engine block 13R. Furthermore, the other pair of the stud bolts 32 . . . of the two pairs of the stud bolts 32 . . . are rooted in the rear journal support wall 27R of the right crankcase 13R and penetrate through the left engine block 13L. Nuts 33 . . . are screw-engaged with the stud bolts 32 . . . projecting from the cylinder head 17L of the left engine block 13L.

Moreover, a pair of the stud bolts 28 . . . are disposed between the stud bolts 32 . . . and the crankshaft 11. The pair of the stud bolts 28 . . . are for fastening the front journal support walls 23L, 23R of the left and right crankcases 13L, 13R and for fastening the rear journal support walls 27L, 27R of the left and right crankcases 13L, 13R.

In addition, the through-bolts 30 . . . and the stud bolts 32 . . . are so disposed as to surround the cylinder bores 18L . . . , 18R . . . at intervals of 90 degrees, for example. The cylinder blocks 13L, 13R are integrally provided with a plurality of mount bosses 34 . . . so as to surround the cylinder bores 18L . . . , 18R . . . , for passing the through-bolts 30 . . . and the stud bolts 32 . . . therethrough. The mount bosses 34 . . . extends from the mount surfaces of the cylinder barrels 16L, 16R for mounting onto the crankcase 21 to the cylinder heads 17L, 17R.

At a front portion of the crankcase 21, a support cylinder 38 constituted by cooperation of the left and right crankcases 14L, 14R is formed so as to project forwards. A front portion of the crankshaft 11 coaxially penetrates through the inside of the support cylinder 38 and is projected from the front end of the support cylinder 38. A ring gear 39 is fixed to the portion, projected from the support cylinder 38, of the crankshaft 11. A spinner (not shown) is coaxially attached to the ring gear 39. Moreover, a slide bearing 40 is intermediately provided between the front portion of the support cylinder 38 and the crankshaft 11, and an annular seal member (not shown) is intermediately disposed between the support cylinder 38 and the crankshaft 11 on the front side relative to the slide bearing 40.

At the time of starting of the engine, a starter 41 exerts a rotational driving force on the crankshaft 11. The starter 41 is a conventionally known one including a starter motor 42 and a pinion 43. The starter motor 42 is supported on a lower portion of the left crankcase 14L in the crankcase 21. The pinion 43 is projected so as to mesh with the ring gear 39 as the rotating speed of the starter motor 42 exceeds a predetermined value. After the starting of the engine, the pinion 43 is released from the ring gear 39, to return into its original position.

In the support cylinder 38, a plurality of projections 44 . . . are provided on the crankshaft 11 at regular intervals in the circumferential direction. A pair of crank angle sensors 45, 45 for detecting the crank angle is attached to the support cylinder 38 by the projections 44 . . . , with a phase difference of 180 degrees therebetween.

Meanwhile, intake ports 48L . . . , 48R . . . corresponding respectively to the combustion chambers 19L . . . , 19R . . . are provided at upper portions of the left and right cylinder heads 17L, 17R, and the intake ports 48R . . . , 48R . . . are each bifurcated to be communicated with the combustion chambers 19L . . . , 19R . . . .

Intake pipes 49L . . . , 49R . . . bent into a circular arc shape are connected to the intake ports 48L . . . , 48R . . . . Electromagnetic fuel injection valves 50L . . . , 5OR . . . for injecting a fuel toward the intake ports 48L . . . , 48R . . . are mounted respectively to intermediate portions of the intake pipes 49L . . . , 49R . . . . The electromagnetic fuel injection valves 50L . . . on the side of the left engine block 13L are connected to a common fuel rail 51L. The electromagnetic fuel injection valves 5OR . . . on the side of the right engine block 13R are connected to a common fuel rail 51R.

On the upper side of the crankcase 21 in the engine main body 12, an intake chamber 52 is disposed in the state of being supported by the engine main body 12. Moreover, the upstream ends of the intake pipes 49L . . . , 49R . . . are connected to the downstream ends of connecting pipes 53L . . . , 53R . . . , upstream end portions of the connecting pipes 53L . . . , 53R . . . are projected into the intake chamber 52 from both sides of the intake chamber 52, and the upstream end portions of the connecting pipes 53L . . . , 53R . . . are enlarged in a horn shape and opened to the rear side, in the intake chamber 52.

The downstream ends of throttle bodies 55, 55 with throttle valves 54, 54 shaft-supported thereon are connected, side by side, to rear portions of the intake chamber 52, and air cleaners 56, 56 are connected to the upstream ends of the throttle bodies 55, 55. Moreover, support stays 57, 57, which are attached to the intake chamber 52 and extending rearwards, support the air cleaners 56, 56.

Exhaust ports 58L . . . , 58R . . . corresponding individually to the combustion chambers 19L . . . , 19R . . . are provided at lower portions of the left and right cylinder heads 17L, 17R, and exhaust pipes 59L . . . , 59R . . . turned round to the lower side of the engine main body 12 and extended rearwards are connected to the exhaust ports 58L . . . , 58R . . . .

Meanwhile, head covers 60L, 60R formed in a roughly H shape are coupled to the left and right cylinders 17L, 17R. A valve operating device (not shown) for driving intake valves and exhaust valves for intake into the combustion chambers 19L . . . , 19R . . . and exhaust from the combustion chambers 19L . . . , 19R . . . is contained between the head covers 60L, 60R and the cylinder heads 17L, 17R. Covers 61L, 61R for covering the portions on the intake valve side of the valve operating device are fastened to upper portion of the head covers 60L, 60R. Covers 62L, 62R for covering the portions on the exhaust valve side of the valve operating device are fastened to lower portions of the head covers 60L, 60R.

Of the valve operating device contained between the head covers 60L, 60R and the cylinder head 17L, 17R, the portions on the intake valve side are for obtaining valve-opening driving forces by push rods. The push rods are pushed upwards in the intake stroke by the power transmitted from the crankshaft 11. The push rods corresponding to the combustion chambers 19L . . . , 19R . . . are axially movably inserted in push rod guide pipes 63L . . . , 63R . . . . The guide pipes 63L . . . , 63R . . . are disposed on the lower side of the cylinder blocks 15L, 15R on both left and right sides of the crankcase 21. The guide pipes 63L . . . , 63R . . . connect between central portions in the front-rear direction of the lower portions of the left and right crankcases 14L, 14R and the head covers 60L, 60R.

In addition, of the valve operating device contained between the head covers 60L, 60R and the cylinder heads 17L, 17R, the portions on the exhaust valve side are for obtaining valve-opening driving forces by pull rods. The pull rods are pulled downwards in the exhaust stroke by the power transmitted from a drive gear 47 of the crankshaft 11. The pull rods corresponding to the combustion chambers 19L . . . , 19R . . . are axially movably inserted in pull rod guide pipes 64L . . . , 64R . . . . The guide pipes 64L . . . , 64R . . . are disposed on the lower side relative to the push rod guide pipes 63L . . . , 63R . . . . The guide pipes 64L . . . , 64R . . . connect between central portions in the front-rear direction of the lower portions of the left and right crankcases 14L, 14R and the head covers 60L, 60R.

Pairs of spark plugs 65L, 65L . . . , 65R, 65R . . . are attached to the cylinder heads 17L, 17R on the basis of each of the combustion chambers 19L . . . , 19R . . . . Ignition coils 66L . . . , 66R . . . as electric components are mounted on side surfaces of upper portions of the cylinder heads 17L, 17R between the intake pipes 49L, 49L; 49R, 49R so as to be arranged in pairs on both sides of the intake chamber 52, and high-tension cords 67 . . . connected in pair to each of the ignition coils 66L . . . , 66R . . . are connected to the spark plugs 65L, 65L . . . , 65R, 65R . . . .

Moreover, ignition in each of the combustion chambers 19L . . . , 19R . . . should be performed securely even when one of the pair of ignition coils 66L . . . , 66R . . . is troubled. Therefore, the pair of high-tension cords 67, 67 connected to the same ignition coil 66L . . . , 66R . . . are connected to the spark plugs 65L . . . , 65R . . . for the different combustion chambers 19L . . . , 19R . . . .

Figure 7:
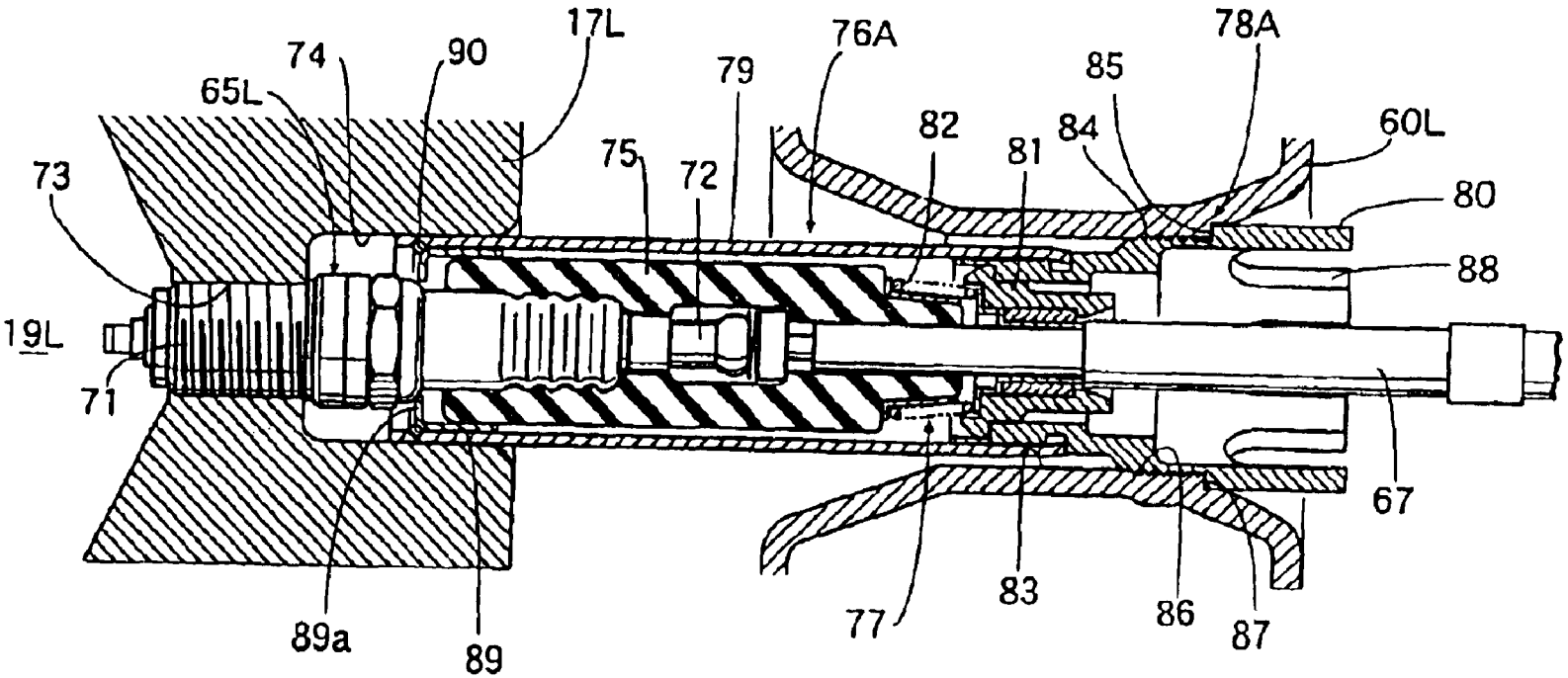
FIG. 7 is an enlarged sectional view taken along line 7—7 of FIG. 6.

In FIG. 7, the cylinder head 17L is coaxially provided with a screw hole 73 and a plug hole 74. The screw hole 73 is for screw engagement with a mount fixture 71 possessed by the spark plug 65L having a tip end portion fronting on the combustion chamber 19L. The plug bole 74 is for containing a rear portion of the spark plug 65L. A synthetic resin-made plug cap 75 for electrically connecting the high-tension cord 67 to a terminal portion 72 possessed by the spark plug 65L at its rear end is elastically fitted over the rear portion of the spark plug 65L.

The plug cap 75 is contained in a plug cap guide 76A whose tip end portion can be inserted into the plug hole 74. The plug cap guide 76A is provided with a pressing portion 77 for pressing the plug cap 75 toward the side of the spark plug 65L, and positioning and fixing means 78A for determining the position in the axial direction of the plug cap guide 76A and fixing the plug cap guide 76A is provided between a rear portion of the plug cap guide 75 and the head cover 60L.

The plug cap guide 76A includes a hollow cylindrical first cylinder member 79 and a hollow cylindrical second cylinder member 80. One end portion of the cylinder member 79 can be inserted into the plug hole 74. The second cylinder member 80 is coupled by caulking with the other end portion of the first cylinder member 79. The plug cap 75 is contained in the first cylinder member 79. Moreover, the first and second cylinder members 79, 80 of the plug cap guide 76A are formed of a conductive metal so as to provide a shield for electrical connection portions of the spark plug 65L and the high-tension cord 67.

The pressing portion 77 is composed of an annular receiving portion 81 and a spring 82. The receiving portion 81 is fixed inside the second cylinder member 80 so as to permit insertion of the high-tension cord 67 therein. The spring 82 is disposed in a contracted state between the receiving member 81 and the plug cap 75. The plug cap 75 is pressed in the direction for elastic fitting over the spark plug 65L, by the spring force of the spring 82.

The head cover 60L is provided with a mount hole 83 coaxial with, and spaced in the axial direction from, the plug hole 74 in the cylinder head 17L. A rear portion of the plug cap guide 76A is fixed to the head cover 60L by the positioning and fixing means 78A in the state of being passed through the mount hole 83.

The positioning and fixing means 78A is composed of a male screw 84, a step portion 85, a female screw 86, and a restriction step portion 87. The male screw 84 is provided at the rear portion of the plug cap guide 76A, i.e., the outer circumference of the second cylinder member 80. The step portion 85 is provided at the outside surface of the second cylinder member 80 of the plug cap guide 78A so as to front on the tip end side on the rear side of the male screw 84. The female screw 86 is provided at an outer end portion of the mount hole 83 in the head cover 60L for screw engagement with the male screw 84. The restriction step portion 87 is provided in the head cover 60L so that the step portion 85 is abutted thereon.

Moreover, at the rear end of the plug cap guide 76A, i.e., at the rear end of the second cylinder member 80, engaging grooves 88 . . . are provided. The engaging grooves 88 . . . engage with a tool such as a driver for rotating the plug cap guide 76A. For example, the grooves 88 are arranged on one diametral line at a plurality of locations in the circumferential direction.

In addition, in a tip end portion of the plug cap guide 76A, i.e., in a tip end portion of the first cylinder member 79, an engaging cylinder 89 provided integrally with a flange-formed engaging portion 89*a* is fitted. The presence of the engaging cylinder 89 between the plug cap 75 and the first cylinder member 79 prevents chattering of the plug cap 75 in the first cylinder member 79. A stop ring 90 for abutment on and engagement with the engaging cylinder 89 from the side of the spark plug 65L is fitted in the inside surface of a tip end portion of the first cylinder member 79. The stop ring 90 prevents the engaging cylinder 89 slipping off from the first cylinder member 79.

The engaging portion 89*a* is capable of engagement with the plug cap 75 from the side of the spark plug 65L at the time of releasing the plug cap guide 76A from the cylinder head 17L. Therefore, the plug cap 75 can be separated from a rear portion of the spark plug 65L according to the operation of releasing the plug cap guide 76A.

The spark plug 65R to be mounted to the cylinder head 17R on the right side is also mounted to the cylinder head 17R and connected to the high-tension cord 67, by use of the same structure as that for the above-mentioned spark plug 65L.

An electronic control unit 95 is mounted to the outside surface of a front side wall of the intake chamber 52, for controlling the operation of the engine. An intake air pressure sensor 96 and an intake air temperature sensor 97 detect the intake air pressure and the intake air temperature in the intake chamber 52. The sensor 96 and 97 are inserted from the electronic control unit 95 into the intake chamber 52 by penetrating through the front side wall.

Meanwhile, the electromagnetic fuel injection valves 50L . . . , 50R . . . , the spark plugs 66L . . . , 66R . . . , and the electronic control unit 95 are disposed in the surroundings of the intake chamber 52. The injection valves 50L . . . , 50R . . . , the spark plugs 66L . . . , 66R . . . , and the control unit 95 are covered with a shield cover 98 attached to the engine main body 12 so as to cover at least a part of the intake chamber 52.

The shield cover 98 is formed, for example, from a steel sheet so as to cover most part, exclusive of a rear portion, of the intake chamber 52 and an upper portion of the engine main body 12 in the first embodiment. An opening edge portion of the shield cover 98 is so formed as to make contact with the engine main body 12. Besides, the high-tension cords 67 extending from the ignition coils 66L . . . , 66R . . . are also partly covered with the shield cover 98.

With the injection valves 50L . . . , 50R . . . , the spark plugs 66L . . . , 66R . . . , and the control unit 95 thus shielded by covering them with one shield cover 98, it is possible to shield the electric components. The cover 98 contrives a reduction in the number of component parts and a more compact overall design, as compared with the case of shielding the electric components individually. Besides, with the high-tension cords 67 . . . also partly covered with the shield cover 98, individual shields of the high-tension cords 67 . . . themselves can be removed at their portions covered with the shield cover 98. As a consequence, secondary voltage drops in the high-tension cords 67 . . . can be improved through the removal of the individual shields.

In addition, the electronic control unit 95 is attached to the outside surface of the front side wall of the intake chamber 52. The intake air pressure sensor 96 and the intake air temperature sensor 97, which detect the intake air pressure and the intake air temperature in the intake chamber 52, are inserted from the electronic control unit 95 into the intake chamber 52 by penetrating through the front side wall. As a result, it is possible to shield the electronic control unit 95, and to connect the sensor 96 and 97 directly to the electronic control unit 95, thereby saving labor for connecting lead wires.

Next, the functions in the first embodiment will be described. The plug caps 75 . . . is elastically fitted over rear portions of the spark plugs 65L . . . , 65R . . . . The spark plugs 65L . . . , 65R . . . attached to the cylinder heads 17L, 17R electrically connect the high-tension cords 67 . . . to the terminal portions 72 . . . possessed by the spark plugs 65L . . . , 65R . . . at the rear ends thereof. The plug caps 75 . . . are contained in the plug cap guides 76A . . . . The plug cap guide 76A is formed in a hollow cylindrical shape so as to contain the plug cap 75 therein, and its tip end portion can be inserted in the plug hole 74 provided in the cylinder head 17L, 17R. Moreover, the plug cap guide 76A is provided with the pressing portion 77 for pressing the plug cap 75 toward the side of the spark plug 65L . . . , 65R . . . . The positioning and fixing means 78A for determining the position in the axial direction of the plug cap guide 76A and fixing the plug cap guide 76A is provided between a rear portion of the plug cap guide 76A and the head cover 60L, 60R.

Therefore, when the plug cap guide 76A with the plug cap 75 contained therein is positioned and fixed to the head cover 60L, 60R, the plug cap 75 being pressed toward the side of the spark plug 65L, 65R is fitted over the rear portion of the spark plug 65L, 65R. In addition, with the plug cap 75 guided by the plug cap guide 76A, the plug cap 75 can be prevented from turning over. As a result, it is possible to enhance the reliability of mounting the plug cap 75 onto the rear portion of the spark plug 65L, 65R.

In addition, the engaging portion 89*a* capable of engagement with the plug cap 75 from the side of the spark plug 65L, 65R is provided at the tip end portion of the plug cap guide 76A. When the positioning and fixing of the plug cap guide 76A to the head cover 60L, 60R are canceled and the plug cap guide 76A is pulled out of the cylinder head 17L, 17R, the engaging portion 89*a* of the plug cap guide 76A comes into engagement with the plug cap 75 from the side of the spark plug 65L, 65R. The plug cap 75 is pushed in the direction for canceling the fitting over the spark plug 65L, 65R according to the operation of pulling out the plug cap guide 76A. As a result, it is possible to enhance the workability in dismounting the plug cap 75 from the rear portion of the spark plug 65L, 65R, while preventing an excessive load from acting on the plug cap 75.

Moreover, the plug cap guide 76A is formed of a conductive metal so as to provide a shield for the electrical connection portions of the spark plug 65L, 65R and the high-tension cord 67. The plug cap guide 76*a* helps to reduce noises emitted from the connection portions to the exterior and to alleviate the influences of high-voltage actions exerted from the exterior to the connection portions.

In addition, the head cover 60L, 60R is provided with the mount hole 83 coaxial with the plug hole 74 provided in the cylinder head 17L, 17R, with an axial spacing provided between the mount hole 83 and the plug hole 74. The rear portion of the plug cap guide 76A is passed through the mount hole 83 and fixed to the head cover 60L, 60R Consequently, it is possible to reduce the space required of the cylinder head 17L, 17R in the surroundings of the plug cap guide 76A for disposing the plug cap guide 76A. Also, enhancing intake and exhaust efficiencies can be realized through reductions in the including angle of intake and exhaust valves disposed in the cylinder head 17L, 17R. As a result, it is possible to enhance the maintainability of the spark plugs 65L, 65R, while realizing an engine in which the spark plugs 65L, 65R are disposed at central areas in the combustion chambers 19L, 19R to contrive enhancement of ignition performance.

Furthermore, the positioning and fixing means 78A is composed of a male screw 84, a step portion 85, a female screw 86, and a restriction step portion 87. The male screw 84 is provided at the outer circumference of a rear portion of the plug cap guide 76A. The step portion 85 is provided at the outside surface of the plug cap guide 76A so as to front on the tip end side. The female screw 86 is provided at the inside surface of the mount hole 83 in the head cover 60L, 60R for screw engagement with the male screw 84. The restriction step portion 87 is provided at the head cover 60L, 60R so that the step portion 85 is abutted thereon. The plug cap guide 76A is provided at its rear end with an engaging groove 88 capable of engagement with a tool for rotating the plug cap guide 76A.

Therefore, it is possible to eliminate the need for a special tool for rotating the plug cap guide 76A, and to easily mount and dismount the plug cap guide 76A onto and from the head cover 60L, 60R, thereby enhancing the maintainability.

Figure 8:
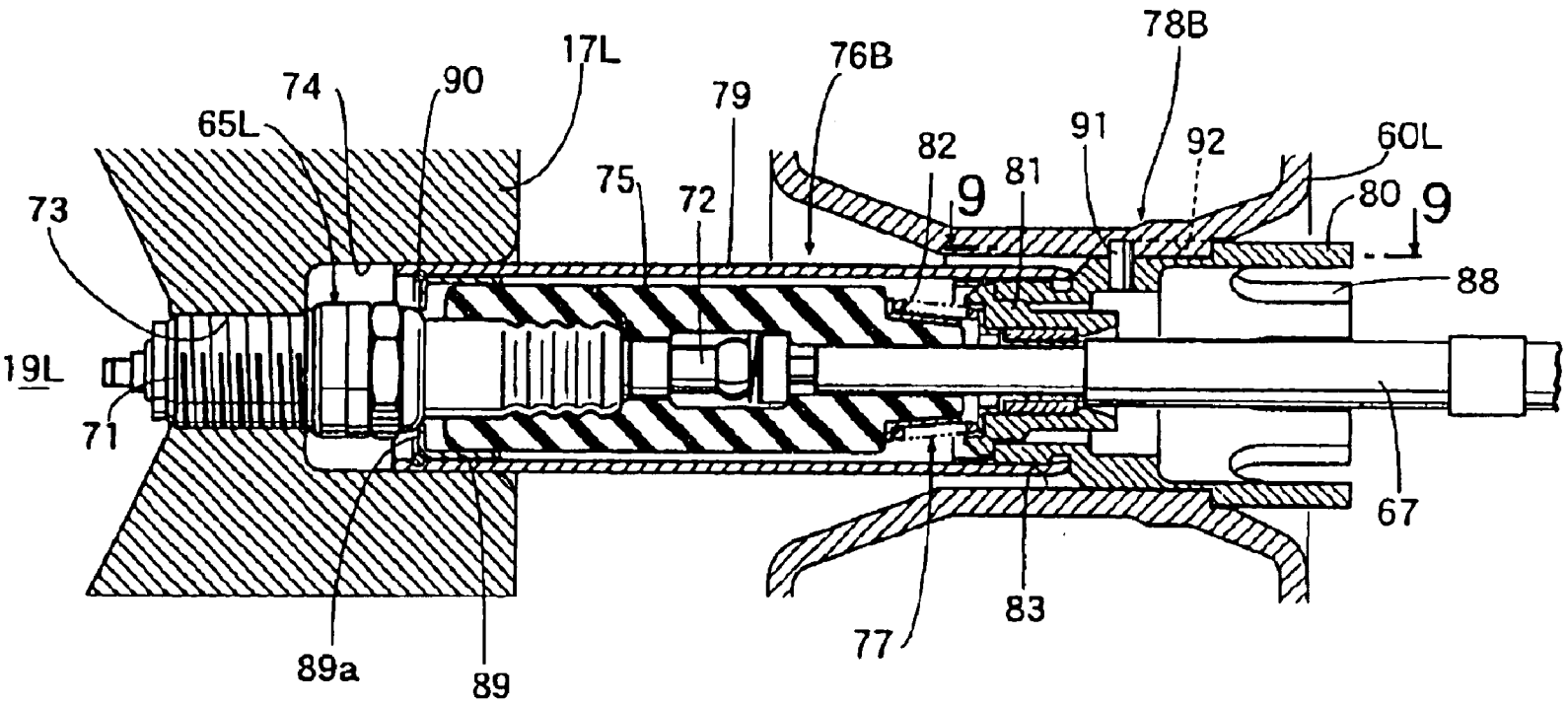
FIG. 8 is a sectional view, corresponding to FIG. 7, for illustrating a second embodiment.
Figure 9:
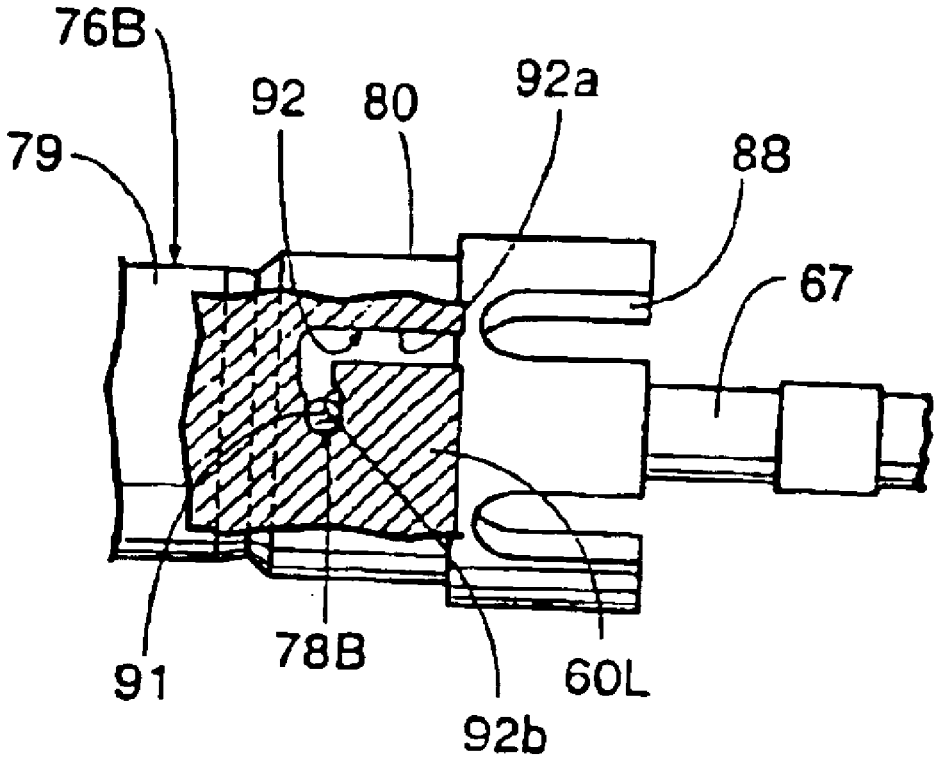
FIG. 9 is a sectional view taken along line 9—9 of FIG. 8.

FIGS. 8 and 9 illustrate a second embodiment of the present invention, in which FIG. 8 is a sectional view corresponding to FIG. 7 of the first embodiment, and FIG. 9 is a sectional view taken along line 9—9 of FIG. 8.

A plug cap 75 is elastically fitted over a rear portion of a spark plug 65L so as to electrically connect a high-tension cord 67 to a terminal portion 72 provided at the rear end of the spark plug 65L. The plug cap 75 is contained in a plug cap guide 76B having a tip end portion insertable in a plug hole 74. The plug cap guide 76B is provided with a pressing portion 77 for pressing the plug cap 75 toward the side of the spark plug 65L. Positioning and fixing means 78B for determining the position in the axial direction of the plug cap guide 76B and fixing the plug cap guide 76B is provided between a rear portion of the plug cap guide 75 and the head cover 60L. The plug cap guide 76B is provided at its tip end portion with an engaging portion 89*a* capable of engagement with the plug cap 75 from the side of the spark plug 65L.

The positioning and fixing means 78B is composed of a pin 91 and a groove 92. The pin 91 is rooted in a rear portion of the plug cap guide 76B so as to have one end portion projected from the outer circumference of the plug cap guide 76B. The groove 92 is provided in the head cover 60L for engagement with the one end portion of the pin 91. The groove 92 is formed in a roughly J shape while including a slide guide portion 92*a* and an engaging groove portion 92*b*. The slide guide portion 92*a* extends in parallel to the axis of the plug cap guide 76B and opening at the outer end thereof. The engaging groove portion 92*b* is continuous with the inner end of the slide groove portion 92*a*.

One end portion of the pin 91 slid inside the slide groove portion 92*a* toward the inner end portion side is engaged with the engaging groove portion 92*b* when the plug cap guide 76B is turned about the axis thereof.

With the second embodiment also, it is possible to easily mount and dismount the plug cap guide 76B onto and from the head cover 60L while eliminating the need for a special tool, and to enhance the maintainability.

While the embodiments of the present invention have been described above, the present invention is not limited to the above embodiments, and various design modifications can be made without departure from the present invention as defined by the claims.

For example, a structure may be adopted in which a bead cap guide is attached to a head cover. Such variations are not to be regarded as a departure from the spirit and scope of the invention, and all such modifications as would be obvious to one skilled in the art are intended to be included within the scope of the following claims.

What is claimed is:

1. A plug cap mount structure for engine, comprising:

a spark plug mounted to a cylinder head, a rear portion of said spark plug being contained in a plug hole provided in said cylinder head;

a plug cap for electrically connecting a high-tension cord to a terminal portion of said spark plug, said plug cap being elastically fitted over the rear portion of said spark plug;

a plug cap guide formed in a hollow cylindrical shape so as to contain said plug cap therein and having a tip end portion insertable in said plug hole, the plug cap guide being provided with a pressing portion for pressing said plug cap toward the side of said spark plug; and positioning and fixing means for determining the position in the axial direction of said plug cap guide and fixing said plug cap guide, the positioning and fixing means being provided between a rear portion of said plug cap guide and said cylinder head or a head cover coupled to said cylinder head.

2. The plug cap mount structure for engine as set forth in claim 1, wherein said plug cap guide is formed of a conductive metal so as to provide a shield for electrical connection portions of said spark plug and said high-tension cord.

3. The plug cap mount structure for engine as set forth in claim 1, wherein a mount hole coaxial with said plug hole is provided in said head cover, with an axial spacing provided between said plug hole and said mount hole, and a rear portion of said plug cap guide is passed through said mount hole and fixed to said head cover.

4. The plug cap mount structure for engine as set forth in claim 1, wherein said positioning and fixing means comprises:

a male screw provided at an outer circumference of a rear portion of said plug cap guide, a step portion provided at an outside surface of said plug cap guide in the state of fronting on the tip end side, a female screw provided in said cylinder head or said head cover for screw engagement with said male screw, a restriction step portion provided in said cylinder head or said head cover so as to make contact with said step portion, wherein an engaging groove capable of engagement with a tool for rotating said plug cap guide is provided at the rear end of said plug cap guide.

5. The plug cap mount structure for engine as set forth in claim 1, wherein said positioning and fixing means comprises:

a pin rooted in a rear portion of said plug cap guide so as to have one end portion projected from an outer circumference of said plug cap guide, and a groove provided in said cylinder head or said head cover for engagement with said one end portion of said pin, and said groove is formed in a roughly J-shape while comprising a slide groove portion extending in parallel to an axis of said plug cap guide and opening at an outer end thereof, and an engaging groove portion being continuous with an inner end of said slide groove portion so that said one end portion of said pin slid in said slide groove portion toward the inner end portion side can be engaged with said engaging groove portion by turning of said plug cap about an axis thereof.

6. The plug cap mount structure for engine as set forth in claim 1, wherein said pressing portion includes an annular receiving portion and a spring.

7. The plug cap mount structure for engine as set forth in claim 6, wherein said receiving portion is fixed inside a second cylinder member so as to permit insertion of the high-tension cord therein.

8. A plug cap mount structure for engine, comprising:

a spark plug mounted to a cylinder head, a rear portion of said spark plug being contained in a plug hole provided in said cylinder head;

a plug cap for electrically connecting a high-tension cord to a terminal portion of said spark plug, said plug cap being elastically fitted over the rear portion of said spark plug;

a plug cap guide formed in a hollow cylindrical shape so as to contain said plug cap therein, the plug cap guide being detachably fixed to said cylinder head or to a head cover coupled to said cylinder head, with a tip end portion of said plug cap guide being inserted in said plug hole, wherein a mount hole coaxial with said plug hole is provided in said head cover, with an axial spacing provided between said plug hole and said mount hole, and a rear portion of said plug cap guide is passed through said mount hole and fixed to said head cover, and wherein an engaging portion is provided at a tip end portion of said plug cap guide, the engaging portion for engagement with said plug cap from the side of said spark plug at a time of releasing said plug cap guide from said cylinder head or said head cover so that said plug cap can be separated from said rear portion of said spark plug during an operation of releasing said plug cap guide.

9. The plug cap mount structure for engine as set forth in claim 8, wherein said plug cap guide is formed of a conductive metal so as to provide a shield for electrical connection portions of said spark plug and said high-tension cord.

10. The plug cap mount structure for engine as set forth in claim 8, further comprising positioning and fixing means, wherein said positioning and fixing means comprises:

a male screw provided at an outer circumference of a rear portion of said plug cap guide, a step portion provided at an outside surface of said plug cap guide in the state of fronting on the tip end side, a female screw provided in said cylinder head or said head cover for screw engagement with said male screw, a restriction step portion provided in said cylinder head or said head cover so as to make contact with said step portion, wherein an engaging groove capable of engagement with a tool for rotating said plug cap guide is provided at a rear end of said plug cap guide.

11. The plug cap mount structure for engine as set forth in claim 8, further comprising positioning and fixing means, wherein said positioning and fixing means comprises:

a pin rooted in a rear portion of said plug cap guide so as to have one end portion projected from an outer circumference of said plug cap guide, and a groove provided in said cylinder head or said head cover for engagement with said one end portion of said pin, and said groove is formed in a roughly J-shape while comprising a slide groove portion extending in parallel to an axis of said plug cap guide and opening at an outer end thereof, and an engaging groove portion being continuous with an inner end of said slide groove portion so that said one end portion of said pin slid in said slide groove portion toward the inner end portion side can be engaged with said engaging groove portion by turning of said plug cap about an axis thereof.

12. The plug cap mount structure for engine as set forth in claim 8, wherein said plug cap guide includes a pressing portion with an annular receiving portion and a spring.

13. The plug cap mount structure for engine as set forth in claim 12, wherein a receiving portion is fixed inside a second cylinder member so as to permit insertion of the high-tension cord therein.

14. The plug cap mount structure for engine as set forth in claim 8, wherein the plug cap guide further comprises:

a cylinder member extending to the tip end portion of the plug cap guide, an engaging cylinder provided integrally with the engaging portion, the engaging portion being fitted into the tip end portion of the plug cap guide, the engaging cylinder being disposed between the plug cap and the cylinder member and preventing chattering of the plug cap in the cylinder member, wherein a stop ring is fitted in an inside surface of a tip end portion of the cylinder member, the stop ring abutting on and engaging with the engaging cylinder from a side of the spark plug, the stop ring for preventing the engaging cylinder from slipping off from the cylinder member.

15. A plug cap mount structure for engine, comprising:

a spark plug mounted to a cylinder head, a rear portion of said spark plug being contained in a plug hole provided in said cylinder head;

a plug cap for electrically connecting a high-tension cord to a terminal portion of said spark plug, said plug cap being elastically fitted over the rear portion of said spark plug;

a plug cap guide formed in a hollow cylindrical shape so as to contain said plug cap therein, the plug cap guide being detachably fixed to said cylinder head or to a head cover coupled to said cylinder head, with a tip end portion of said plug cap guide being inserted in said plug hole;

wherein an engaging portion is provided at a tip end portion of said plug cap guide, the engaging portion for engagement with said plug cap from a side of said spark plug at a time of releasing said plug cap guide from said cylinder head or said head cover so that said plug cap can be separated from said rear portion of said spark plug during an operation of releasing said plug cap guide, and further comprising positioning and fixing means, said positioning and fixing means including:

a male screw provided at an outer circumference of a rear portion of said plug cap guide;

a step portion provided at the an surface of said plug cap guide in the state of fronting on the tip end side;

a female screw provided in said cylinder head or said head cover for screw engagement with said male screw;

a restriction step portion provided in said cylinder head or said head cover so as to make contact with said step portion, wherein an engaging groove capable of engagement with a tool for rotating said plug cap guide is provided at a rear end of said plug cap guide.

16. The plug cap mount structure for engine as set forth in claim 15, wherein said plug cap guide is formed of a conductive metal so as to provide a shield for electrical connection portions of said spark plug and said high-tension cord.

17. The plug cap mount structure for engine as set forth in claim 15, wherein said positioning and fixing means comprises:

a pin rooted in a rear portion of said plug cap guide so as to have one end portion projected from an outer circumference of said plug cap guide, and a groove provided in said cylinder head or said head cover for engagement with said one end portion of said pin, and said groove is formed in a roughly J-shape while comprising a slide groove portion extending in parallel to an axis of said plug cap guide and opening at an outer end thereof, and an engaging groove portion being continuous with the an end of said slide groove portion so that said one end portion of said pin slid in said slide groove portion toward the inner end portion side can be engaged with said engaging groove portion by turning of said plug cap about an axis thereof.

18. The plug cap mount structure for engine as set forth in claim 15, wherein the plug cap guide further comprises:

a cylinder member extending to the tip end portion of the plug cap guide, an engaging cylinder provided integrally with the engaging portion, the engaging portion being fitted into the tip end portion of the plug cap guide, the engaging cylinder being disposed between the plug cap and the cylinder member and preventing chattering of the plug cap in the cylinder member, wherein a stop ring is fitted in an inside surface of a tip end portion of the cylinder member, the stop ring abutting on and engaging with the engaging cylinder from a side of the spark plug, the stop ring for preventing the engaging cylinder from slipping off from the cylinder member.

* * * * *